US007740456B2

(12) United States Patent
Jung et al.

(10) Patent No.: US 7,740,456 B2
(45) Date of Patent: Jun. 22, 2010

(54) SUCTION SILENCER AND COMPRESSOR THEREWITH

(75) Inventors: Min Kyu Jung, Changwon-si (KR); Dong Woo Park, Busan-si (KR)

(73) Assignee: LG Electronics Inc., Seoul (KR)

( * ) Notice: Subject to any disclaimer, the term of this patent is extended or adjusted under 35 U.S.C. 154(b) by 961 days.

(21) Appl. No.: 10/919,287

(22) Filed: Aug. 17, 2004

(65) Prior Publication Data

US 2005/0042115 A1 Feb. 24, 2005

(30) Foreign Application Priority Data

Aug. 18, 2003 (KR) ..... 10-2003-0056833

(51) Int. Cl.
*F04B 53/00* (2006.01)

(52) U.S. Cl. ..... 417/312; 181/229; 181/281; 62/296

(58) Field of Classification Search ..... 417/312, 417/902; 181/403, 212, 281; 62/296
See application file for complete search history.

(56) References Cited

U.S. PATENT DOCUMENTS 6,358,019 B1 * 3/2002 Iversen et al. ..... 417/312
6,506,028 B2 * 1/2003 Silveira et al. ..... 417/312
6,692,238 B2 * 2/2004 Myung et al. ..... 417/312
6,715,582 B2 * 4/2004 Nissen et al. ..... 181/231
6,845,843 B2 * 1/2005 Svendsen et al. ..... 181/262
7,052,248 B2 * 5/2006 Yagi et al. ..... 417/312
2002/0076335 A1 * 6/2002 Silveira et al. ..... 417/312
2002/0090305 A1 * 7/2002 Myung et al. ..... 417/312
2002/0134617 A1 * 9/2002 Nissen et al. ..... 181/403
2002/0185333 A1 * 12/2002 Svendsen ..... 181/229
2003/0150670 A1 * 8/2003 Svendsen et al. ..... 181/262
2004/0241011 A1 * 12/2004 Yagi et al. ..... 417/312

FOREIGN PATENT DOCUMENTS

WO WO 03048574 A1 * 6/2003

* cited by examiner

*Primary Examiner*—Devon C Kramer
*Assistant Examiner*—Patrick Hamo
(74) *Attorney, Agent, or Firm*—KED & Associates, LLP

(57) ABSTRACT

A suction silencer in a compressor is disclosed, including a lower shell having an opened top, that draws refrigerant, and an upper shell fixed to the top of the lower shell to form an inside space that reduces noise of drawn refrigerant, and that discharges refrigerant in a direction different from a flow direction of the refrigerant introduced into the lower shell, thereby simplifying a structure to permit easy assembly.

15 Claims, 4 Drawing Sheets

SUCTION SILENCER AND COMPRESSOR THEREWITH

CROSS-REFERENCE TO RELATED APPLICATIONS

This application claims the benefit of Korean Application No. P2003-56833, filed on Aug. 18, 2003, which is hereby incorporated by reference as if fully set forth herein.

BACKGROUND OF THE INVENTION

1. Field of the Invention

The present invention relates to compressors for compressing a working fluid, such as refrigerant to a predetermined pressure, and more particularly, to a suction silencer for reducing noise of refrigerant drawn for compression, having a structure, of which configuration is made simple, and assembly of which is convenient; and a compressor therewith.

2. Description of the Related Art

In the compressor, for compressing a working fluid, such as gas, or refrigerant, to a pressure, there are, in general, turbo compressors, such as axial compressors, and centrifugal compressors, and displacement type compressors, such as rotary compressors and reciprocating compressors.

The reciprocating compressor has a piston reciprocating in a cylinder for drawing and compressing gas or refrigerant.

A related art reciprocating compressor (hereafter compressor) is provided with a shell having an upper shell and a lower shell, a compression part in the shell for compressing refrigerant, and a driving part for driving the compression part.

The compression part is provided with a compression chamber for compressing and discharging refrigerant drawn thereto, a suction silencer for reducing noise from refrigerant being drawn to the compression chamber, an inlet pipe for guiding the refrigerant to the suction silencer, and the like.

However, the suction silencer having many components increases production cost, and reduces productivity due to a complicated fabrication process.

Moreover, the more the number of components of the suction silencer, the more the assembly defects caused by assembly tolerance, to cause refrigerant leakage or failure of assembly.

SUMMARY OF THE INVENTION

Accordingly, the present invention is directed to a suction silencer and a compressor therewith that substantially obviates one or more problems due to limitations and disadvantages of the related art.

An object of the present invention is to provide a suction silencer of which structure is made simple to enable an easy assembly, and a compressor therewith.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a suction silencer in a compressor includes a lower shell having an opened top, for drawing refrigerant, and an upper shell fixed to the top of the lower shell to form an inside space for reducing noise of drawn refrigerant, for discharging refrigerant in a direction different from a flow direction of the refrigerant introduced into the lower shell.

The lower shell includes an inlet passage having one end fixed to the lower shell, and the other end projected outward, for guiding refrigerant into the inside space.

The lower shell further includes a first extension pipe having one end connected to one end of the inlet passage, and the other end extended toward an inside wall of the inside space.

The inlet passage has the other end expanded like a trumpet.

The upper shell includes an outlet pipe having one end fixed to an outside wall of the upper shell, and the other end projected outwardly, for discharging refrigerant having noise reduced in the inside space.

The upper shell further includes a second extension pipe having one end connected to one end of the outlet pipe, and the other end extended toward the inside space.

The flow direction of the refrigerant introduced into the inside space is perpendicular to a flow direction of the refrigerant discharged from the inside space.

The upper shell and the lower shell are fastened with hooks on one of the upper shell and the lower shell, and hook slots on the other one of the upper shell and the lower shell.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
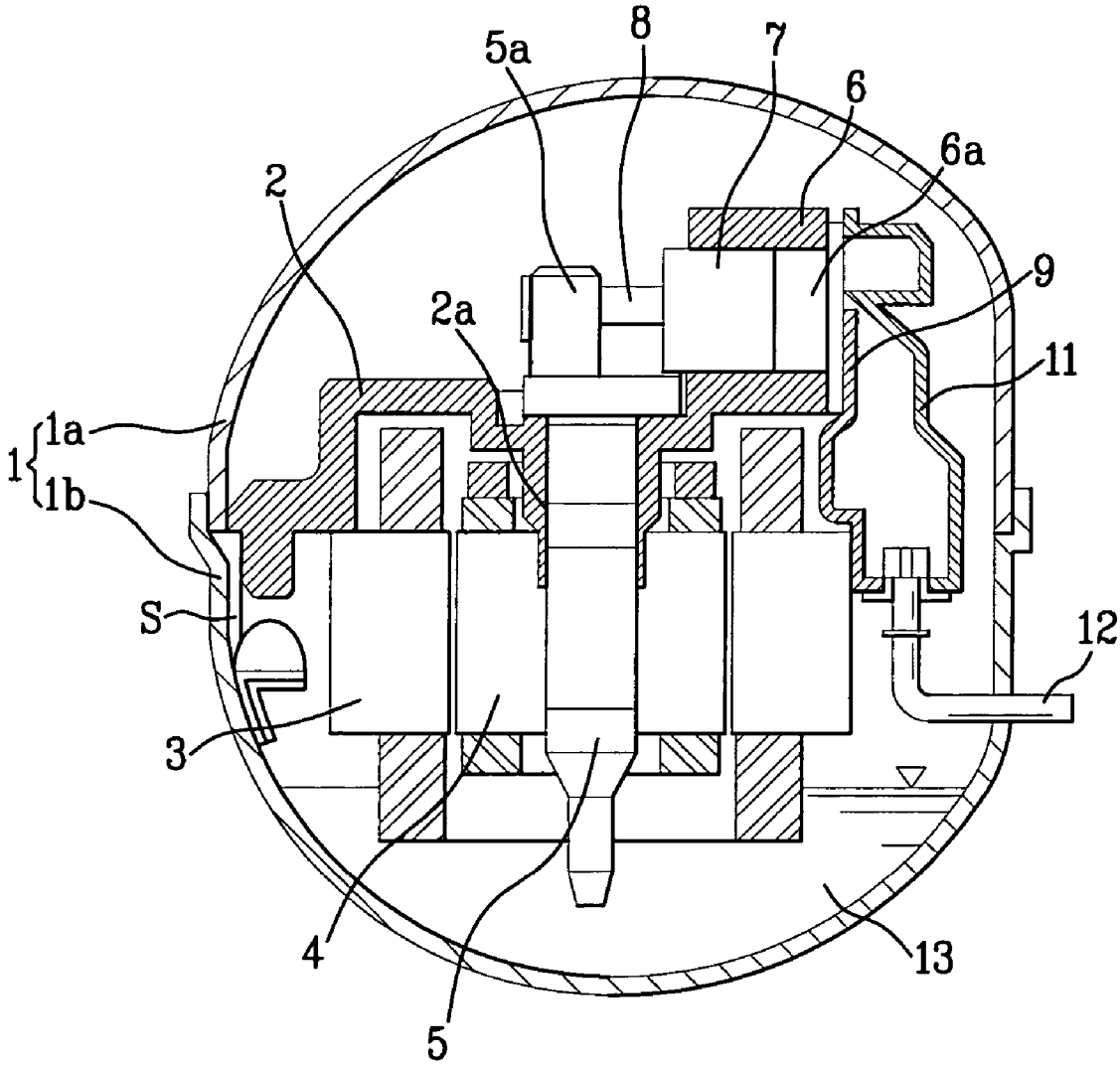
FIG. 1 illustrates a section of a compressor in accordance with a preferred embodiment of the present invention.

FIG. 1 illustrates a section of a compressor in accordance with a preferred embodiment of the present invention.

Referring to FIG. 1, the compressor includes a shell 1 having an upper shell 1*a* and a lower shell 1*b* for holding various parts, and a frame 2 in the shell 1 supported on springs 'S' having the various parts fastened thereto.

The frame 2 has a boss 2*a* with a vertical hollow at a central portion thereof, and a crankshaft 5 is rotatably mounted on the vertical hollow.

The crankshaft 5 has oil passages (not shown), for guiding oil 13 from a bottom of the shell 1 to an upper portion of the shell through the oil passage, and spraying onto the frame 2. To do this, the crankshaft 5 has a pumping mechanism (not shown) at a lower end thereof for pumping up the oil 13 to the oil passage.

The crankshaft 5 is rotated by the motor part, and the motor part includes a stator 3 fixed to a lower portion of the frame, and a rotor 4 coupled to the crankshaft 5 for rotating in an electro-magnetic interaction with the stator 3.

At a top of the crankshaft 5, there is a crankpin 5*a* eccentric from a rotation axis of the crankshaft 5. Opposite to the crankpin 5*a*, there is a balance weight (not shown), for making a rotation speed of the crankshaft 5 constant.

At one side of an upper portion of the shell 1, there is a cylinder 6 having a compression chamber 6*a* therein as one unit with the frame 1. The cylinder 6 is provided with a piston 7 for compression of refrigerant or gas, and the piston 7 is connected to the crankpin 5*a* at top of the crankshaft 5 with a connecting rod 8 for converting a rotation of the crankshaft 5 to a linear motion.

There is a valve assembly 9 mounted on the cylinder 6 for regulating refrigerant flow in/out of the compression chamber 6*a*. The valve assembly 9 includes a suction valve for drawing the refrigerant, and a discharge valve for discharging the compressed refrigerant.

A head cover (not shown) is mounted to the valve assembly for separating refrigerant drawn in/discharged from the compression chamber 6*a*.

In the meantime, at one side of the head cover, there is a suction silencer 11 having one end connected to the inlet pipe 12 for receiving refrigerant from an outside of the compressor, for reducing noise of the refrigerant being introduced into the compression chamber 6*a*.

Figure 2:
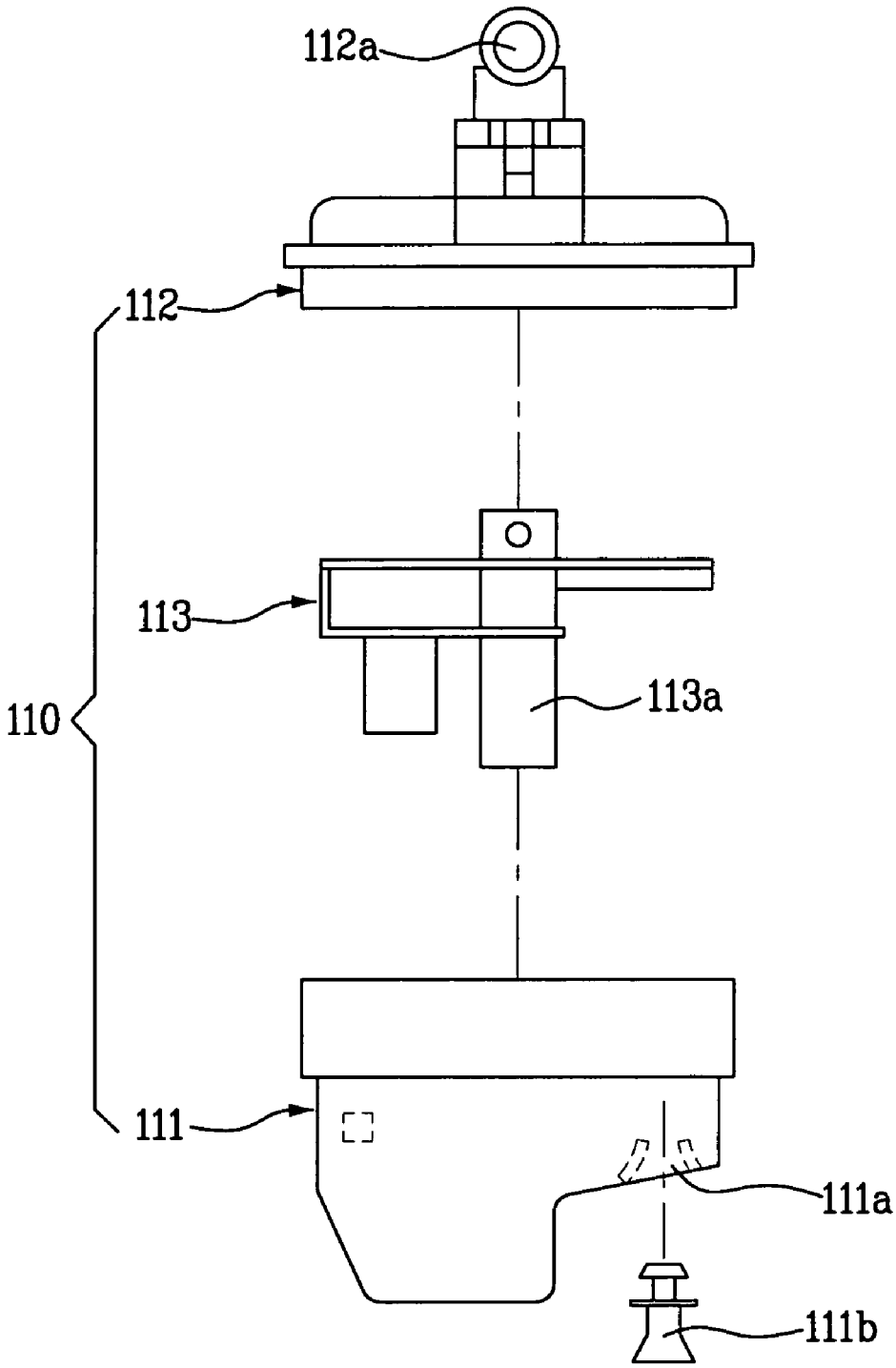
FIG. 2 illustrates a disassembled view of a suction silencer in accordance with a first preferred embodiment of the present invention.

FIG. 2 illustrates a disassembled view of a suction silencer in accordance with a first preferred embodiment of the present invention.

Referring to FIG. 2, the suction silencer 110 includes a lower shell 111 having an opened top, an upper shell 112 on the lower shell for forming an inside space together with the lower shell, and a partition 113 for dividing the inside space into an upper space and a lower space.

The lower shell 111 has an inlet 111*a* for guiding refrigerant from the inlet pipe 12 to the inside space, and the inlet 111*a* has a connection cap 111*b* inserted therein, and fastened thereto, for connection between the inlet pipe 12 and the suction silencer 110.

The upper shell 112 has an outlet 112*a* at a top thereof for discharging refrigerant to the compression chamber 6*a* in a state where noise is reduced within the suction silencer 110.

The partition 113 has a communication pipe 113*a* penetrating the partition 113 in a vertical direction, as a passage of the refrigerant moves from the lower space to the upper space.

A noise damping process of the suction silencer 110 in accordance with a first preferred embodiment of the present invention will be described.

The refrigerant introduced into an inside space through the inlet 111*a* is involved in a first time noise reduction by an impact occurring as the refrigerant hits an under side of the partition 113.

The refrigerant is also involved in a second time noise reduction as a pressure and pulsation of the refrigerant is reduced, the refrigerant expands from the inlet 111*a* to the lower space of the partition 113, which has a larger volume than the inlet 111*a*.

Then, the refrigerant is also involved in a third time noise reduction as the refrigerant is introduced from the lower space into the upper space of the partition through the communication pipe 113*a* in the partition, and discharged to the compression chamber 6*a* through the outlet in the upper shell 112.

Figure 3:
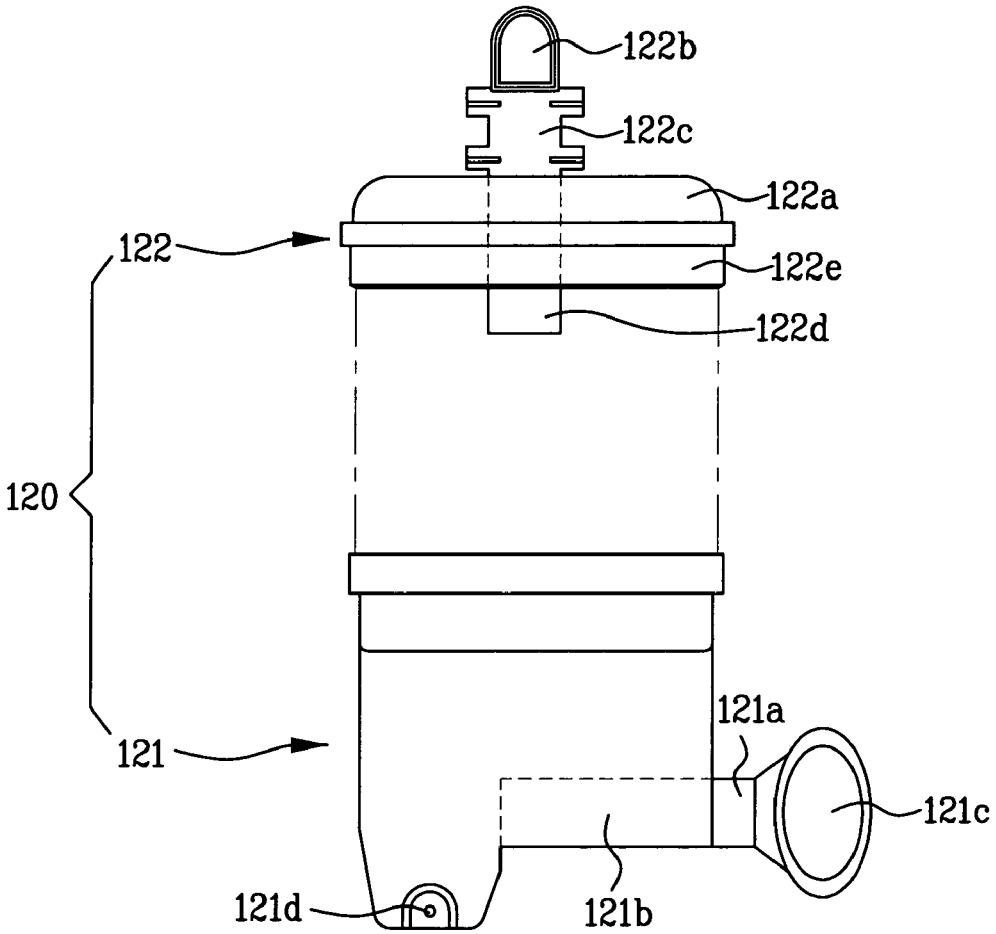
FIG. 3 illustrates a disassembled view of a suction silencer in accordance with a second preferred embodiment of the present invention.
Figure 4:
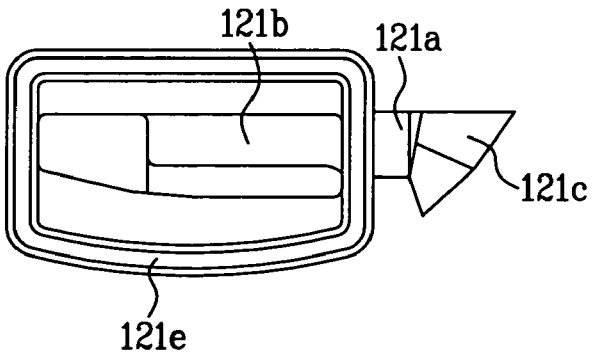
FIG. 4 illustrates a plan view of a lower shell of the suction silencer in FIG. 3.

FIG. 3 illustrates a disassembled view of a suction silencer in accordance with a second preferred embodiment of the present invention, having a structure simpler than the first embodiment.

Referring to FIG. 3, the suction silencer 120 includes a lower shell 121, and an upper shell 122 fixed to a top of the lower shell 121.

The lower shell 121 has a space formed therein, and an opened top, and the upper shell 122 has an opened bottom, to form an inside space together with the lower shell 121, for reducing noise of the refrigerant.

The lower shell 121 has an inlet passage 121*a* at a side of a lower portion, having one end fixed to an outside wall of the lower shell 121, and the other end projected outwardly from the wall, for guiding refrigerant introduced into the inside space formed by the upper shell 122 and the lower shell 121.

The other end of the inlet passage 121*a* projected outwardly from the lower shell 121 is connected to the inlet pipe 12 for drawing refrigerant from an outside of the suction silencer 120, and guiding the refrigerant to the suction silencer 120. For this, it is preferable that the other end of the inlet passage 121*a* has an inlet guide 121*c* expanded like a trumpet formed as one unit with the inlet passage for connection to the inlet pipe 12.

Of course, the inlet guide 121*c* may be provided by attaching a separate member fabricated as above to the other end of the inlet passage 121*a* with adhesive.

It is preferable that there is a first extension pipe 121*b* extended from the inlet passage 121*a* toward an inner side of and along a bottom of the lower shell 121 as one unit with the inlet passage 121*a*.

It is preferable that the inlet passage 121*a* and the first extension pipe 121*b*, which guide the refrigerant to an inside of the suction silencer, are fixed so as to form a unit with the lower shell 121*a*.

The lower shell 121 has an oil drain hole 121*d* in a bottom surface, and a fastening groove 121*e* at a top circumference. The fastening groove 121*e* has a fastening end 122*e* at the upper shell 122 inserted therein, which will be described, later.

In the meantime, the upper shell 122 includes a cap 122*a*, and an outlet pipe 122*c* projected upward from the cap 122*a*, having a bottom end fixed to a top of the cap 122*a*, and a top end with an outlet 122*b*.

The outlet pipe 122*c* guides noise dampened refrigerant toward the compression chamber 6*a* of the cylinder 6.

There is a second extension pipe 122*d* extended downward from a bottom end formed as a unit with the outlet pipe 122*c*, and the cap 122*a* has a fastening end 122*e* at a bottom end of the cap 122*a*, for inserting in the fastening groove 121*e* of the lower shell 121.

The outlet pipe 122*c* and the second extension pipe 122*d* are passages for guiding the refrigerant from the inside space of the suction silencer 120 to the compression chamber 6*a*.

In the embodiment, it is preferable that the outlet pipe 122*c* and the second extension pipe 122*d* are formed as one unit with the cap 122*a* for simplicity of structure and assembly.

The lower shell 121 and the upper shell 122 may be bonded with adhesive in assembling the lower shell 121 and the upper shell 122.

For bonding with adhesive, the fastening end 122*e* of the upper shell 122 is inserted in the fastening groove 121*e* of the lower shell 121.

Then, the adhesive is filled between the fastening end 122*e* and the fastening groove 121*e*, to bond the lower shell 121 and the upper shell 122 rigidly, for preventing leakage of the refrigerant from the inside space.

Of course, after applying adhesive to either side of the fastening end 122*e* or fastening groove 121*e*, or both sides thereof, the fastening end may be inserted in the fastening groove, and bonded together.

Different from above, hooks (not shown) may be formed on one of the lower shell 121 and the upper shell 122, and hook slots (not shown) are formed on the other one of the lower shell 121 and the upper shell 122, for inserting the hooks in the hook slots to fasten the lower shell 121 and the upper shell 122, or after putting the lower shell 121 and the upper shell 122 together, a separate fastening member, such as clamp (not shown), may be provided to one side of the lower shell 121 and the upper shell 122, to form the suction silencer 120.

Fabrication processes of the lower shell 121 and the upper shell 122 of the suction silencer 120 will be described.

The lower shell 121 may be formed by injecting plastic, or the like, into a predetermined form of a mold, and the inlet passage 121*a* and the first extension pipe 121*b* may be formed by adding forms of the inlet passage 121*a* and the first extension pipe 121*b* to the mold.

Different from this, the inlet passage 121*a* and the first extension pipe 121*b* may be formed with punching means, such as drill, or the like, or by passing a separate pipe through a wall of, and fixing it to the lower shell 121.

Next, the upper shell 122 having the cap 122*a* with the outlet pipe 122*c* and the second extension pipe 122*d* formed as one unit may be formed by injecting plastic into a predetermined form of mold, and the outlet pipe 122*c* and the second extension pipe 122*d* may be formed as one unit with the cap 122*a* by adding forms of the outlet pipe 122*c* and the second extension pipe 122*d* to the mold.

Different from this, the outlet pipe 122*c* and the second extension pipe 122*d* may be formed as one unit with the cap 122*a* by passing the outlet pipe 122*c* and the second extension pipe 122*d*, which are formed as one unit separately, through a top of, and fixing to the cap 122*a*. In other words, after forming a pass through hole (not shown) at the top of the cap 122*a*, by inserting the second extension pipe 122*d* formed as one unit with the outlet pipe 122*c* through the pass through hole, and fixing thereto with adhesive, the cap 122*a* having the outlet pipe 122*c* and the second extension pipe 122*d* formed as one unit is formed.

Methods for fabricating the lower shell 121 and the upper shell 122 are not limited to above, but may vary depending on designer's selection.

Refrigerant flow through the suction silencer 120 of the lower shell 121 and the upper shell 122 will be described with reference to FIG. 5.

Figure 5:
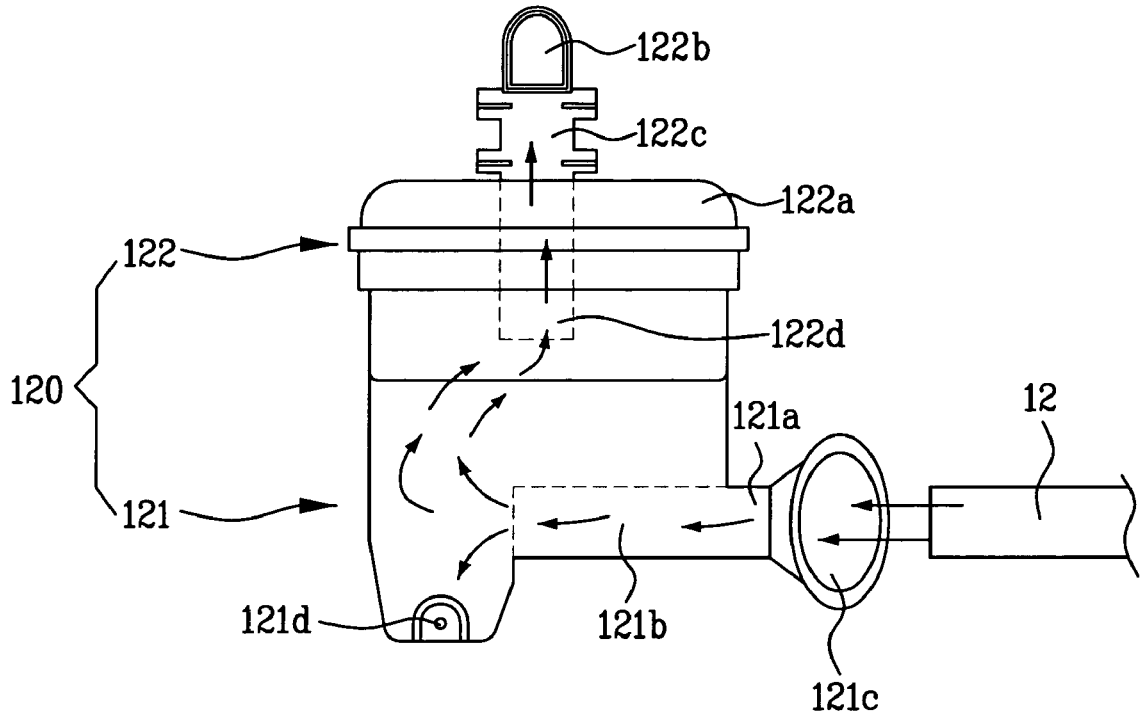
FIG. 5 illustrates a flow of refrigerant through the suction silencer in accordance with a second preferred embodiment of the present invention.

Referring to FIG. 5, the refrigerant drawn through the inlet pipe 12 is introduced into the inside of the suction silencer 120 through the inlet passage 121*a* having the inlet guide 121*c* formed thereon, and the first extension pipe 121*b* connected to the inlet pipe 12.

That is, the refrigerant drawn through the inlet passage 121*a* having the inlet guide 121*c* is introduced into an inside of the lower shell 121 through the first extension pipe 121*b* extended to an inside of the lower shell 121, and expanded to an inside space of the suction silencer 120.

The refrigerant introduced into, and expanded in the lower shell 121 hits an inside wall of the lower shell 121, when oil 13 in the refrigerant falls down by gravity. The oil 13 fallen down to a bottom of the lower shell thus is drained to an outside of the suction silencer 120 through the oil drain hole 121*d*.

In the meantime, the refrigerant expanded to an inside space of the suction silencer 120 is introduced into the second extension pipe 122*d* mounted vertically through the upper shell 122, and introduced into the compression chamber 6*a* through the outlet pipe 122*c* having an outlet 122*b*.

In above refrigerant flow process, noise damping by the suction silencer 120 will be described.

The refrigerant introduced into an inside through the inlet passage 121*a* and the first extension pipe 121*b* is involved in noise damping for the first time by an impact occurred as the refrigerant hits an inside wall of the suction silencer 120, i.e., an inside wall of the lower shell 121.

The refrigerant introduced into an inside through the inlet passage 121*a* and the first extension pipe 121*b* is also involved in noise damping for the second time by reduction of a pressure and pulsation in a process the refrigerant expands to the inside space of the suction silencer 120 having a volume larger than the inlet passage 121*a*.

The reduction of noise of the refrigerant by the suction silencer 120 permits a quiet compressor operation.

The suction silencer and a compressor therewith have the following advantages.

First, the simple components of the suction silencer permit reduction of a fabrication cost, and to simplify an assembly process, thereby improving productivity.

Second, in the second embodiment, the formation of the outlet pipe to the upper shell for guiding the refrigerant to the outlet, and the formation of the inlet guide as one unit with the inlet passage of the lower shell for serving as the connection cap permits a structure of the suction silencer more simple than the first embodiment.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A suction silencer for a compressor, the suction silencer comprising:

a lower shell having an opened top portion;

an upper shell having an opened bottom portion, wherein an outer peripheral edge of the opened bottom portion of the upper shell is coupled to an outer peripheral edge of the opened top portion of the lower shell so as to form a single interior space in which the opened top portion of the lower shell is aligned with the opened bottom portion of the upper shell with a substantially completely open transition therebetween;

an inlet passage provided at an outer wall of the lower shell;

a first extension pipe having a first end connected to an outlet end of the inlet passage, and a second end positioned in an inside of the single interior space, wherein the inlet passage and the first extension pipe are formed as a single unit with the lower shell, and wherein the first extension pipe extends from the inlet passage along a bottom portion of the lower shell towards a side wall portion of the lower shell that is opposite a side wall portion of the lower shell at which the inlet passage is provided such that the second end of the first extension pipe faces the opposite side wall portion of the lower shell;

an outlet pipe that extends outward from a top portion of the upper shell; and a second extension pipe coupled only to an inlet end of the outlet pipe and extending downward into the single interior space, wherein the second end of the first extension pipe and an inlet into the second extension pipe are positioned in the single interior space such that fluid flowing out of the second end of the first extension pipe impinges against the opposite side wall portion of the lower shell and changes direction prior to flowing into the inlet of the second extension pipe, and wherein a distance between the second end of the first extension pipe and the opposite side wall portion of the lower shell is less than a distance between the inlet of the second extension pipe and the opposite side wall portion of the lower shell.

2. The suction silencer as claimed in claim 1, wherein the inlet passage has a first end fixed to the lower shell, and a second end that projects outward from the lower shell so as to guide refrigerant into the single interior space.

3. The suction silencer as claimed in claim 2, wherein the second end of the inlet passage is funnel-shaped.

4. The suction silencer as claimed in claim 1, wherein the outlet pipe has a first end fixed to the upper shell, and a second end that projects outward from the upper shell so as to discharge noise reduced refrigerant from the interior space.

5. The suction silencer as claimed in claim 1, wherein the single interior space defined by the upper and lower shells is unobstructed between the first and second extension pipes such that fluid flows freely therebetween.

6. The suction silencer as claimed in claim 1, wherein fluid is introduced into the lower shell through the first extension pipe in a first direction and is discharged from the upper shell through the second extension pipe and the outlet pipe in a second direction that is different from the first direction.

7. The suction silencer as claimed in claim 1, wherein the inlet passage and the first extension pipe are aligned along a transverse axis of the suction silencer, and the second extension pipe and the outlet pipe are aligned along a longitudinal axis of the suction silencer, and wherein the opposite interior wall of the lower shell is oriented such that the fluid impinging thereon in the transverse axis direction changes direction and flows in the longitudinal axis direction.

8. A compressor comprising the suction silencer of claim 1.

9. The suction silencer as claimed in claim 5, wherein the fluid flowing freely between the first and second extension pipes expands as it flows between the first and second extension pipes so as to reduce a pressure level and a pulsation level of the fluid.

10. The suction silencer as claimed in claim 7, wherein the transverse axis direction is perpendicular to the longitudinal axis direction.

11. A compressor, comprising:

a compression part that draws in low pressure refrigerant, compresses the refrigerant, and discharges high pressure refrigerant; and a suction silencer that reduces a noise level of refrigerant as it is drawn in, and discharges the noise reduced refrigerant to the compression part, wherein the suction silencer comprises:

a lower shell having an opened top portion;

an upper shell having an opened bottom portion fixed to the opened top portion of the lower shell so as to form a single interior space having a substantially completely open transition between upper and lower portions of the single interior space;

an inlet passage provided at a first side wall portion of the lower shell;

a first extension pipe having a first end connected an outlet end of the inlet passage, and a second end positioned in an inside of the single interior space, wherein the inlet passage and the first extension pipe are formed as a single unit with the lower shell, and wherein the first extension pipe extends from the inlet passage along a bottom portion of the lower shell towards a second side wall portion of the lower shell that is opposite the first side wall portion of the lower shell such that the second end of the first extension pipe faces the second side wall portion of the lower shell;

an outlet pipe provided in the upper shell; and a second extension pipe having a first end connected to an inlet of the outlet pipe and a second end positioned in the inside of the single interior space, wherein refrigerant flowing out of the first extension pipe in a first direction impinges against the second side wall portion of the lower shell, expands in the single interior space and changes direction prior to flowing into the second extension pipe and being discharged in a second direction so as to reduce a noise level of the refrigerant, and wherein a distance between the second end of the first extension pipe and the second side wall portion of the lower shell is less than a distance between the second end of the second extension pipe and the second side wall portion of the lower shell.

12. The compressor as claimed in claim 11, wherein the inlet passage has a first end fixed to the lower shell, and a second end that projects outward from the lower shell so as to guide refrigerant into the single interior space.

13. The compressor as claimed in claim 12, wherein the second end of the inlet passage is funnel-shaped.

14. The compressor as claimed in claim 11, wherein the outlet pipe has a first end fixed to the upper shell, and a second end that projects outward from the upper shell so as to discharge noise reduced refrigerant from the single interior space.

15. The suction silencer as claimed in claim 11, wherein the first direction is perpendicular to the second direction.

* * * * *